US007504003B2

(12) United States Patent
Kronholm

(10) Patent No.: US 7,504,003 B2
(45) Date of Patent: Mar. 17, 2009

(54) ARRANGEMENT IN A HEADBOX

(75) Inventor: Harri Kronholm, Tampere (FI)

(73) Assignee: VAAHTO Oy, Hollola (FI)

( * ) Notice: Subject to any disclaimer, the term of this patent is extended or adjusted under 35 U.S.C. 154(b) by 517 days.

(21) Appl. No.: 11/285,108

(22) Filed: Nov. 23, 2005

(65) Prior Publication Data

US 2006/0157215 A1 Jul. 20, 2006

(30) Foreign Application Priority Data

Dec. 8, 2004 (FI) ..... 20041580

(51) Int. Cl.
*D21F 1/06* (2006.01)

(52) U.S. Cl. ..... 162/343; 162/344; 162/346

(58) Field of Classification Search ..... 162/343, 162/344, 336
See application file for complete search history.

(56) References Cited

U.S. PATENT DOCUMENTS 3,607,625 A 9/1971 Hill et al.
4,941,950 A * 7/1990 Sanford ..... 162/343
2002/0153113 A1 * 10/2002 Ruf et al. ..... 162/216

FOREIGN PATENT DOCUMENTS

| | | | |
|---|---|---|---|
| DE | 42 37 310 | A1 | 4/1993 |
| DE | 200 15 471 | U1 | 11/2000 |
| EP | 1 236 828 | A1 | 9/2002 |
| EP | 1 428 929 | A1 | 6/2004 |
| FI | 925162 | | 5/1994 |

* cited by examiner

*Primary Examiner*—Mark Halpern
(74) *Attorney, Agent, or Firm*—Birch, Stewart, Kolasch & Birch, LLP

(57) ABSTRACT

An arrangement in the headbox of a paper or cardboard machine has a pulp suspension feed system distributing the suspension over the width of the headbox. At least one first flow resistance element, such as an aperture plate and/or tube system, is provided with flow apertures, from which headbox the pulp suspension is passed via at least one chamber, such as an equalizing chamber and/or the slice gap of a slice chamber, onto a forming wire or equivalent. The arrangement comprises at least one pulp flow guide plate, preferably arranged mainly in the transverse direction of the headbox, having at least one groove formed in its guide surface.

17 Claims, 2 Drawing Sheets

ARRANGEMENT IN A HEADBOX

BACKGROUND OF THE INVENTION

The present invention relates to an arrangement in the headbox of a paper or cardboard machine as defined in the preamble of claim 1, said headbox comprising a pulp suspension feed system that distributes the suspension over the width of the headbox, at least one first flow resistance element, such as a perforated plate and/or tube system provided with flow apertures, from which headbox the pulp suspension is passed via at least one chamber, such as an equalizing chamber and/or the slice gap of a slice chamber, onto a forming wire or equivalent.

The invention concerns the headbox, most appropriately a hydraulic headbox of a paper or cardboard machine. The invention relates to modification of the internal flow within the headbox.

There are prior-art solutions in headboxes, preferably hydraulic ones, that comprise two successive tube systems used to influence the pulp flow in the headbox, e.g. by creating turbulence. At present, in the last tube system in the direction of pulp flow, the tail end of the so-called turbulence generator as seen in the direction of flow is so shaped that it properly fills the lip channel of the headbox, the purpose of which is to establish an even flow in the transverse direction of the machine.

The prior-art tube and tube system are very difficult and expensive to manufacture. In addition, it would be most advantageous to design the shape and size of the tubes according to the flow quantity, which leads to a very expensive structural solution.

Another device used in headboxes are guide plates, also called as trailing plates, baleen plates, or lamellas, which start from the end of the forming tubes and extend in the slice chamber to a point near the headbox lips. The purpose of these plates is to bring a turbulent flow in separation from the other rows to the lip, thus maintaining a high turbulence level. The trailing plates, baleen plates or lamellas are used as a means of correcting the wrongly sized forming tubes at the tail end of the tube system. A solution of this type is disclosed in U.S. Pat. No. 3,607,625.

In another prior-art solution, a system of baffle plates extending over a substantial part of the length of the equalizing chamber is arranged on the exit side of the first tube system, i.e. flow resistance, as seen in the direction of pulp flow. The two opposite surfaces of the baffle plates consist of continuous surface structure in the transverse direction over the entire width of the headbox, without any substantial discontinuities, the baffle plates being thus arranged to balance the pulp flow partly via the pressure loss occurring as the pulp flow relatively suddenly expands at the edge of the baffle plate. A solution of this type is disclosed in patent specification FI 93874 B.

The object of the present invention is to create a completely new type of solution that will obviate the drawbacks of prior art and to achieve a new type of solution for controlling fiber orientation and formation. Another object is to produce a solution that is more advantageous in respect of manufacturing technology for the above-mentioned purpose.

BRIEF DESCRIPTION OF THE INVENTION

The invention is based on a concept whereby guide plates with grooves formed in their guide surfaces to control the pulp flow are used in the headbox.

The arrangement of the invention is mainly characterized in that the arrangement comprises at least one pulp flow guide plate preferably arranged mainly in the transverse direction of the headbox and provided with at least one groove formed in its guide surface.

The arrangement of the invention is additionally characterized by what is stated in claims 2-17.

The solution of the invention has numerous significant advantages. The invention makes it possible to replace the forming tube with two plates having grooves formed in the direction of flow or with a number of such plates depending on the number of rows. If necessary, a different groove shape and size can be selected for each flow rate range. The cross-sectional form of the groove can be easily shaped in a considerable variety of ways in a direction perpendicular to the longitudinal direction of the groove. The walls of the groove can be given a curved shape in the cross-sectional direction of the groove, e.g. the shape of a portion of a circular or elliptical arc, a rectangular shape, the shape of a portion of the circumference of a polygon, a U-shaped or V-shaped form, and so on. It is characteristic of the plate pair that the space of the groove is open towards the adjacent groove. The space between the grooves may also be expanding of converging or it may remain constant throughout the flow distance. Thus, by using the grooved plate system in question, this problem is eliminated and an ideal residual variation of the final product is achieved. By applying the invention, an ideal control of fiber orientation and formation in connection with the headbox is achieved. The use of guide plates with at least one groove formed in them also makes it possible to achieve a solution advantageous in respect of manufacturing technology that can be easily modified for different embodiments.

By arranging several guide plates one over the other spaced by a distance, better flow control is achieved. An arrangement where the entry end of the groove is located at the point of supply of the pulp flow, e.g. directly opposite to the inlet flow opening, allows very good control of the flow components. The shape and/or size of the groove can be fitted to be different at different parts of the guide plate and/or between different guide plates, thus achieving a solution that allows very versatile possibilities of variation. The invention allows the use of several grooves as well as different types of grooves even in the same guide plate. The guide surface of the guide plate can be arranged to be at an angle to the main direction of flow, which allows the flow to be influenced in very versatile ways. The thickness of the guide plate may vary. The guide plate may be so formed that it has a greater thickness on the flow entry side, which in an embodiment is also the fastening side of the guide plate. In this case, a better fastenability and also sufficient properties in respect of technical strength are achieved. On the other hand, if desirable, the guide plate can be so formed that it is thinner on the flow entry side than on the flow exit side. The guide plate can be formed to a desired width. It may extend over the entire width of the headbox in the space where it is arranged. Similarly, several parallel guide plates can be arranged. When guide plates arranged one above the other spaced by a distance are used, the grooves opening towards another guide plate in the plates placed one above the other can be arranged to be at least partially in alignment with each other at least in the transverse direction of the machine.

The grooved plate system in question can be used in at least one, preferably both of the tube systems, both in the tube system coming into the equalizing chamber and in connection with the turbulence generator, to produce an ideal fiber distribution in the transverse direction of the machine and to set an ideal turbulence level in the longitudinal direction of the machine.

BRIEF DESCRIPTION OF THE FIGURES

In the following, the invention will be described in detail with reference to an example and the attached drawings, wherein.

DETAILED DESCRIPTION OF THE INVENTION

Figure 1:
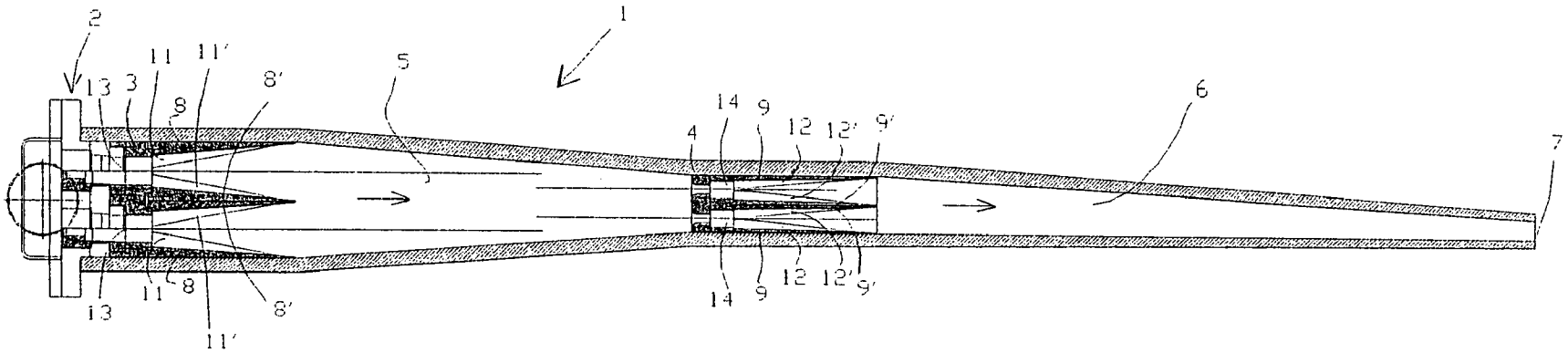
FIG. 1 presents an arrangement according to the invention in connection with a headbox.
Figure 2:
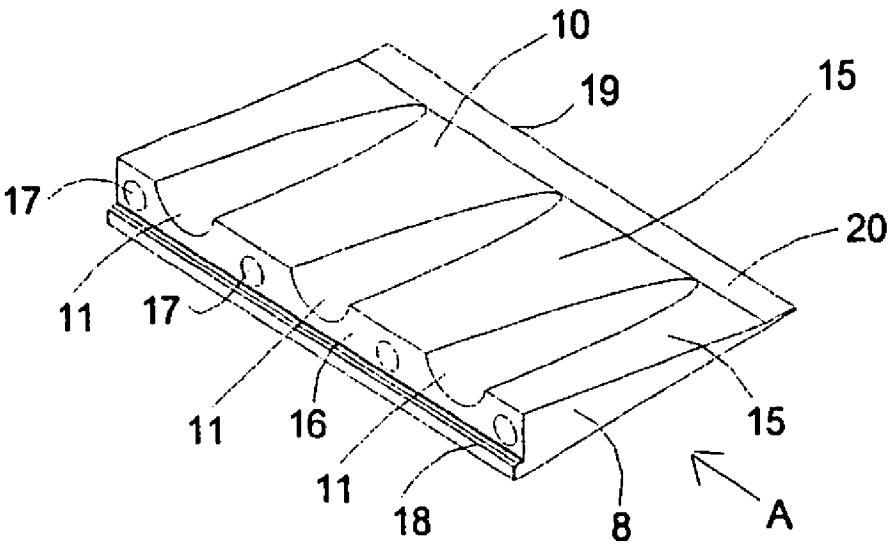
FIG. 2 presents a guide plate according to the invention.
Figure 2A:
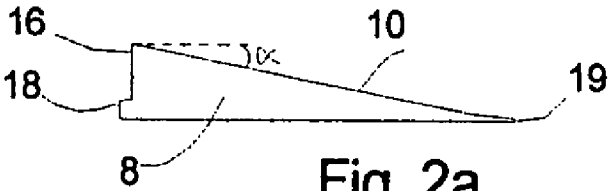
FIG. 2*a* shows the guide plate from the direction of arrow A in FIG. 2.

FIG. 1 presents a partially sectioned side view of a headbox using the arrangement of the invention. The headbox 1 comprises a pulp suspension supply system 2 which distributes the suspension over the width of the headbox, at least one first flow resistance element 3, 4, such as an aperture plate and/or tube system provided with flow apertures. From the headbox, the pulp suspension is passed through at least one chamber 5, 6, such as an equalizing chamber and/or the slice gap 7 of a slice chamber, onto a forming wire or equivalent. FIGS. 2 and 2*a* present a guide plate used in the arrangement according to FIG. 1.

The arrangement comprises at least one pulp flow guide plate 8, 8', 9, 9' preferably arranged mainly in the transverse direction of the headbox, said guide plate having at least one groove 11, 11', 12, 12' formed in its guide surface 10, 10'.

According to a preferred embodiment, the headbox is provided with several guide plates 8, 8'; 9, 9' arranged at a distance from each other. The solution according to FIG. 1 comprises four guide plates 8, 8' arranged in the equalizing chamber 5. Of these, the middlemost ones 8', 8' could alternatively also be formed as a single guide plate. Correspondingly, arranged in the slice chamber 6 in connection with the turbulence generator in this embodiment are guide plates 9, 9', of which the middlemost plates 9', 9' could also be formed as a single plate. In the embodiment according to FIGS. 2, 2*a* and 2*b*, the grooved plate comprises holes 17 formed in their fastening surface 16 for fastening means, such as screws. The guide plate is provided with a shoulder 18 extending to a distance from the fastening surface 16. The shoulder has been arranged to fit into a groove provided in a counterpiece placed in the headbox. The guide plate 8 in the figure has at its exit side end an edge area 20 to which the grooves 11 do not extend.

The groove 11, 11', 12, 12' is typically formed at the point of entry of the flow in the direction of pulp flow, e.g. directly opposite to the inlet flow opening 13, 14. In the solution according to the figures, a plane parallel to the guide surface of the guide plates intersects the inlet flow opening 13, 14. In this case, in an embodiment, the beginning of the grooves may form an extension of the inlet flow opening. The guide plates are typically arranged between superimposed rows of flow openings and above the topmost row and below the bottommost row. The essential point is that the pulp flow enters between the guide plates. On the other hand, in some embodiments the topmost and the bottommost guide plate can even be replaced with the top or bottom wall of the chamber, respectively. The number of inlet flow openings in the rows and the number of rows depend on the embodiment and its requirements.

The shape and/or size of the groove can be fitted to be different at different parts of the guide plate 8, 8'; 9, 9' and/or between different guide plates 8, 8', 9, 9'.

The guide plate 8, 8'; 9, 9' may have several grooves formed in it, the plate thus comprising several grooves 11, 11'; 12, 12' and shoulder ridges 15, 15' between them.

Figure 2B:
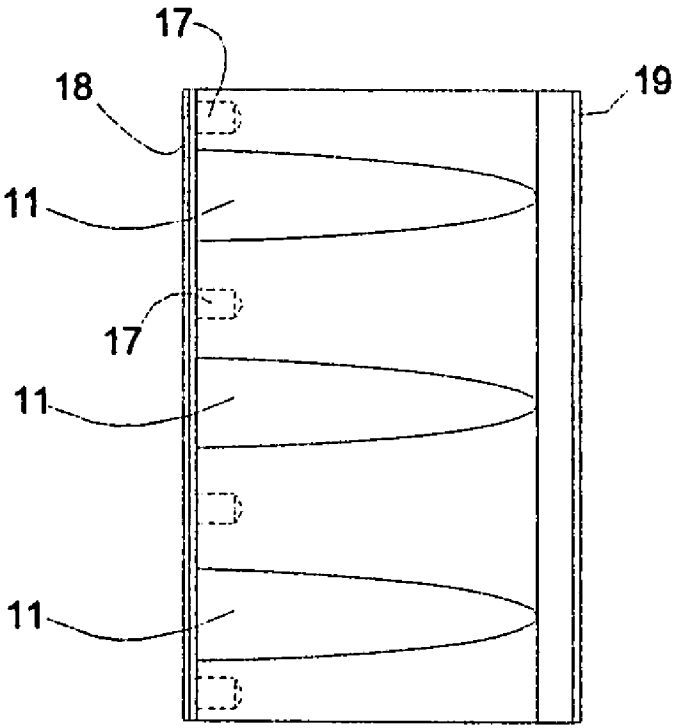
FIG. 2*b* presents the guide plate in top view.

In the embodiment in FIGS. 2, 2*a* and 2*b*, the guide surface 10, 10' of the guide plate has been arranged to be at an angle ($\alpha$) relative to the main direction of flow. Naturally, depending on the embodiment, this angle may vary between different plates, and it may even have different magnitudes on the same plate at different points along the width of the headbox.

According to an embodiment, the guide plate 8, 8'; 9, 9' is thicker on the flow entry side than on the exit side. According to another embodiment again, the guide plate 8, 8'; 9, 9' is thinner on the flow entry side than on the exit side. According to yet another embodiment, the guide plate 8, 8'; 9, 9' is substantially uniform in thickness. Depending on the embodiment, guide plates differing from each other can be used in the headbox.

The guide plate 8, 8'; 9, 9' typically extends over the entire width of the headbox. It is also possible to use guide plates only extending over part of the width of the headbox. Thus, different guide plates having different properties can easily be formed for different parts along the width of the headbox.

As stated above, the guide plate 8, 8' is arranged in the equalizing chamber 5 of the headbox. Similarly, the guide plate 9, 9' can be arranged in the slice chamber 6 of the headbox.

Typically, but not necessarily, the grooves 11, 11', 12, 12' formed in the two superimposed guide plates 8, 8'; 9, 9' so that they start from the same inlet flow opening 13, 14 are at least partially aligned with each other at least in the transverse direction of the machine.

The guide plate 8, 8'; 9, 9' has been arranged in the first wall 3, 4, as seen in the direction of flow, of the chamber following the flow resistance element and so that it extends to a distance from the first wall. In this case, plates 8, 8' are arranged in the front wall or equivalent of the equalizing chamber, which is where the flow apertures lead to. In the embodiment in FIG. 1, the second guide plates have been arranged in the front wall or equivalent of the slice chamber, which is where the inlet flow openings or tubes of the turbulence generator in the figure lead to.

The space between the mutually aligned grooves 11, 11', 12, 12' of the superimposed guide plates 8, 8'; 9, 9' expands in the direction of flow or converges in the direction of flow or remains substantially constant in the direction of flow through at least part of the length of the groove. In the embodiments according to the figures, the space between the grooves expands in the direction of flow. The space would converge if the guide plates were arranged the other way round, i.e. fastened by their thinner edge to the front wall (not shown) of the chamber. The space would remain constant at least if the distance between the plates remained unchanged and the grooves were of constant depth.

The grooves need not necessarily extend over the entire length of the plate in the direction of flow. Typically at least one groove 11, 11'; 12, 12' extends in the direction of flow over at least part of the length of the guide surface of at least one guide plate 8, 8'; 9, 9' in the direction of flow. The guide plate and/or different guide plates can be provided with grooves of different shapes and/or lengths, depending on the requirements of the embodiment. The grooves may have a curved or angular shape in the cross-sectional direction. Depending on the material used, the grooves can be machined in the plate, e.g. by milling. It is also conceivable that the guide plates are e.g. cast into a desired shape.

The aim of the invention is to replace the previously widely used forming tube with two plates provided with grooves formed in the direction of flow or with a number of such plates depending on the number of rows. A different groove shape and size can be selected for each flow rate range. The shape of the groove may vary, and it may have e.g. a circular, square or rectangular form. The plate pair is characterized in that the groove space is open into the adjacent groove. The space between the grooves may also be expanding or converging or it may remain constant throughout the flow distance. Thus, by using the grooved plate system in question, this problem is eliminated and an ideal residual variation of the final product is achieved.

The dimensions of the grooves naturally depend on the embodiment. In one embodiment, the depth of the grooves varies between 3 mm-40 mm, at least on the flow entry side. The grooves may extend over the entire length of the guide plate in the direction of flow or only over part of its length in the direction of flow. The length of the guide plates in the flow direction may vary according to the embodiment. It is conceivable that the guide plates extend in the flow direction starting from about 10 mm up to the relevant length of the chamber concerned, such as the equalizing chamber or slice chamber.

It is obvious to the person skilled in the art that the invention is not limited to the embodiments described above, but that it may be varied within the scope of the claims presented below. Features that may have been presented together with other features in the description can also be used separately from each other if necessary.

The invention claimed is:

1. An arrangement in the headbox of a paper or cardboard machine, said headbox comprising a pulp suspension feed system, which distributes the suspension over the width of the headbox, at least one first flow resistance element, from which headbox the pulp suspension is passed via at least one first chamber, and one second chamber, onto a forming wire, wherein the arrangement comprises several guide plates arranged in a transverse direction of the headbox at a distance from each other in the first chamber of the headbox, each guide plate having a flow entry side and an exit side, and wherein at least one groove is formed in a guide surface of each of two superimposed guide plates so that the grooves start from the same inlet flow opening and are partially aligned or aligned with each other at least in the transverse direction.

2. An arrangement according to claim 1, wherein the at least one groove has been formed at the point of entry of the flow in the direction of pulp flow directly opposite to the inlet flow opening.

3. An arrangement according to claim 1, wherein the shape and/or size of the at least one groove is fitted to be different at different parts of the guide plate and/or between different guide plates.

4. An arrangement according to claim 1, wherein each guide plate has several grooves with shoulder ridges between the grooves.

5. An arrangement according to claim 1, wherein the guide surface of the guide plate is at an angle to the main direction of flow.

6. An arrangement according to claim 1, wherein the guide plate is thicker on the flow entry side than on the exit side.

7. An arrangement according to claim 1, wherein the guide plate is thinner on the flow entry side than on the exit side.

8. An arrangement according to claim 1, wherein the guide plate is substantially uniform in thickness.

9. An arrangement according to claim 1, wherein the guide plate extends substantially over the entire width of the headbox.

10. An arrangement according to claim 1, wherein at least one further guide plate is arranged in the second chamber of the headbox.

11. An arrangement according to claim 1, wherein, as seen in the direction of flow, the guide plate is arranged in a first wall of the chamber following the flow resistance element and so that it extends to a distance from the first wall.

12. An arrangement according to claim 4, wherein the space between the mutually aligned grooves of the superimposed guide plates expands in the direction of flow or converges in the direction of flow or remains substantially constant in the direction of flow over at least part of the length of the groove.

13. An arrangement according to claim 1, wherein at least one groove extends in the direction of flow over at least part of the length of the guide surface of at least one guide plate.

14. An arrangement according to claim 1, wherein the guide plate and/or different guide plates is/are provided with grooves of different shapes and/or lengths.

15. An arrangement according to claim 1, wherein the flow resistance element comprises an aperture plate and/or tube system provided with flow apertures.

16. An arrangement according to claim 1, wherein the first chamber is an equalizing chamber.

17. An arrangement according to claim 1, wherein the second chamber is a slice chamber.

* * * * *